US005772679A

United States Patent [19]

Mann

[11] Patent Number: 5,772,679

[45] Date of Patent: Jun. 30, 1998

[54] EARRING PIERCER ASSEMBLY FOR STUD GUNS

[75] Inventor: Samuel J. Mann, Englewood, N.J.

[73] Assignee: Inverness Corporation, Fair Lawn, N.J.

[21] Appl. No.: 600,695

[22] Filed: Jun. 19, 1996

[51] Int. Cl.[6] ..... A61B 17/34

[52] U.S. Cl. ..... 606/188

[58] Field of Search ..... 606/188, 184, 606/185; 24/27, 37

[56] References Cited

U.S. PATENT DOCUMENTS

| | | | |
|---|---|---|---|
| 2,798,491 | 7/1957 | Samuels . | |
| 3,187,751 | 6/1965 | Coren et al. . | |
| 3,941,134 | 3/1976 | McDonald . | |
| 3,943,935 | 3/1976 | Cameron . | |
| 4,009,718 | 3/1977 | Hastings . | |
| 4,020,848 | 5/1977 | DiCicco . | |
| 4,030,506 | 6/1977 | McDonald . | |
| 4,030,507 | 6/1977 | Mann . | |
| 4,068,668 | 1/1978 | Moore et al. . | |
| 4,079,740 | 3/1978 | Phalon . | |
| 4,146,032 | 3/1979 | Rubenstein et al. . | |
| 4,516,577 | 5/1985 | Scott et al. . | |
| 4,527,563 | 7/1985 | Reil . | |
| 4,860,474 | 8/1989 | Sciara . | |
| 4,921,494 | 5/1990 | Neil . | |
| 4,931,060 | 6/1990 | Aue . | |
| 4,943,294 | 7/1990 | Knapp . | |
| 5,004,470 | 4/1991 | Mann . | |
| 5,004,471 | 4/1991 | Mann . | |
| 5,007,918 | 4/1991 | Mann | 606/188 |
| 5,211,653 | 5/1993 | Nakajima . | |
| 5,263,960 | 11/1993 | Mann | 606/188 |
| 5,350,394 | 9/1994 | Mann | 606/188 |
| 5,360,434 | 11/1994 | Mann . | |
| 5,389,105 | 2/1995 | Mann . | |
| 5,441,514 | 8/1995 | Durham . | |
| 5,496,343 | 3/1996 | Reil . | |
| 5,499,993 | 3/1996 | Blomdahl et al. . | |

*Primary Examiner*—Michael Buiz
*Assistant Examiner*—William Lewis
*Attorney, Agent, or Firm*—Stroock & Stroock & Lavan LLP

[57] ABSTRACT

A product and method are provided for piercing an ear with an ornamental earring using a conventional stud gun. An earring retainer is provided with an interior cavity sized and shaped to conform generally to the outer dimensions of the ornamental portion of a post-type earring so that when the earring is enclosed within the retainer, the retainer will prevent pivoting of the earring relative to the retainer. The retainer has an outer diameter dimensioned to fit snugly in the plunger of a conventional stud gun and prevent the retainer from pivoting or shifting significantly with respect to the plunger or retainer during use. The retainer can also have a physical feature, such as a notch or ridge, so that it can be releasably mounted on a carrying block and placed in the plunger of the stud gun without the need for a user to touch any portion of the retainer or earring prior to use.

31 Claims, 4 Drawing Sheets

FIG. 1
PRIOR ART
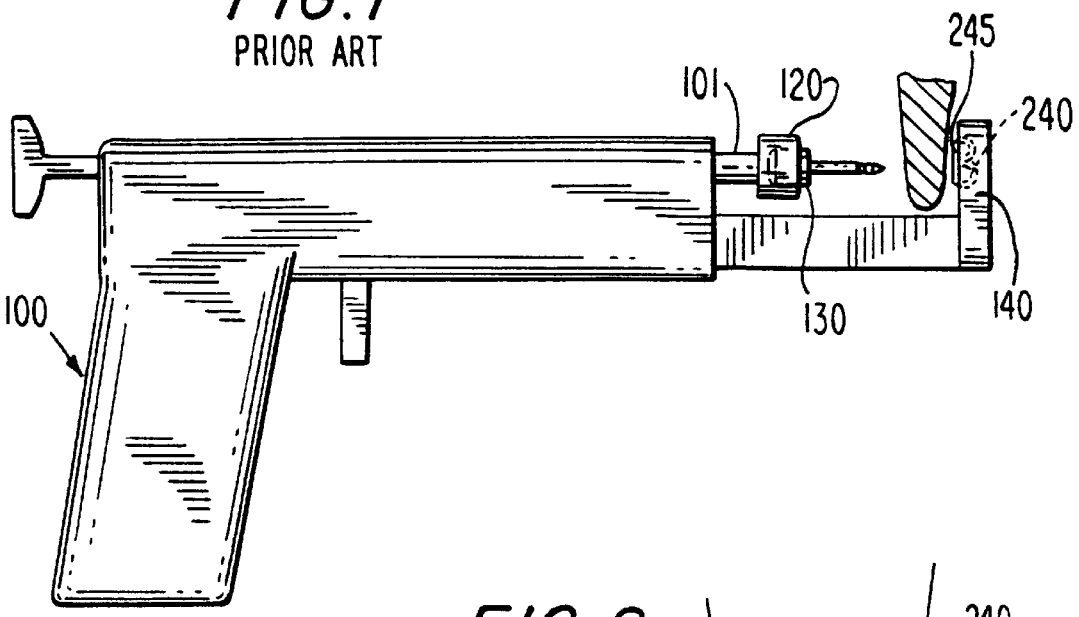
FIG. 2
PRIOR ART
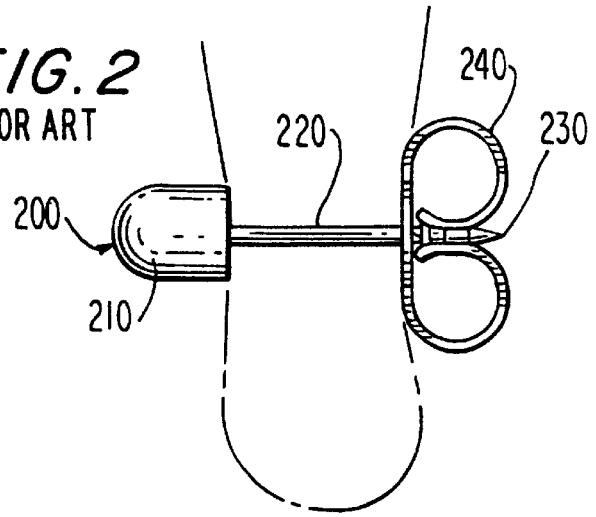
FIG. 4
PRIOR ART
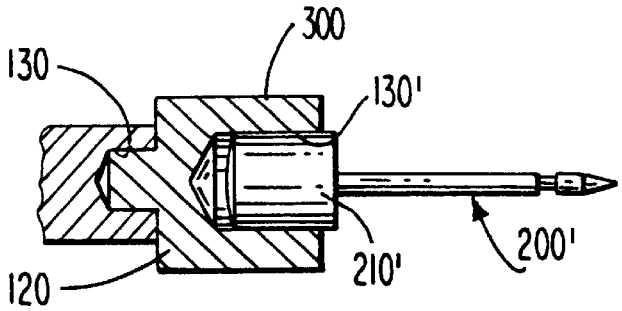
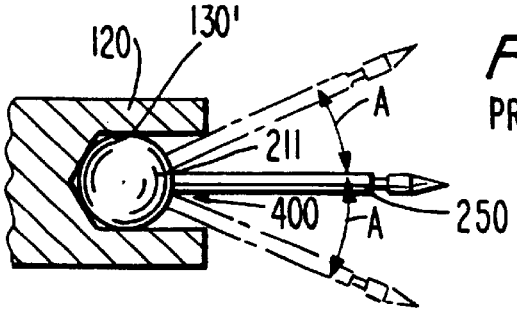
FIG. 3
PRIOR ART

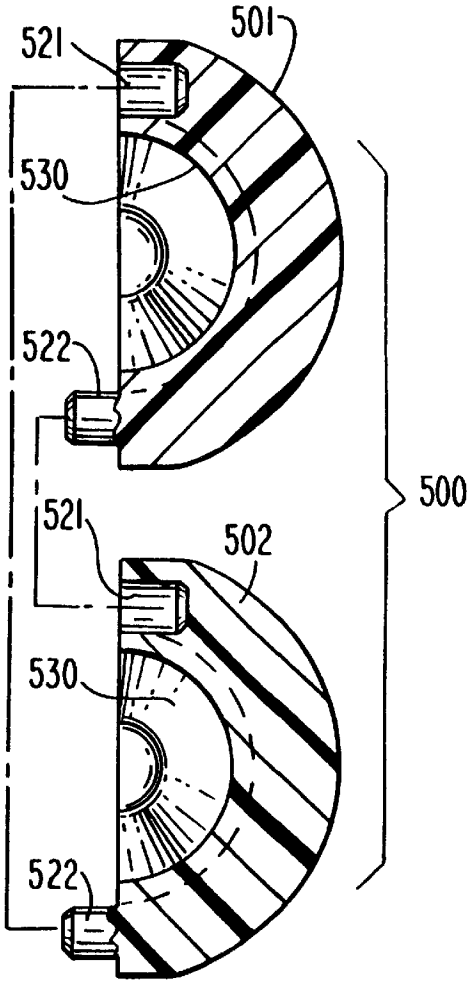
FIG. 6
FIG. 5
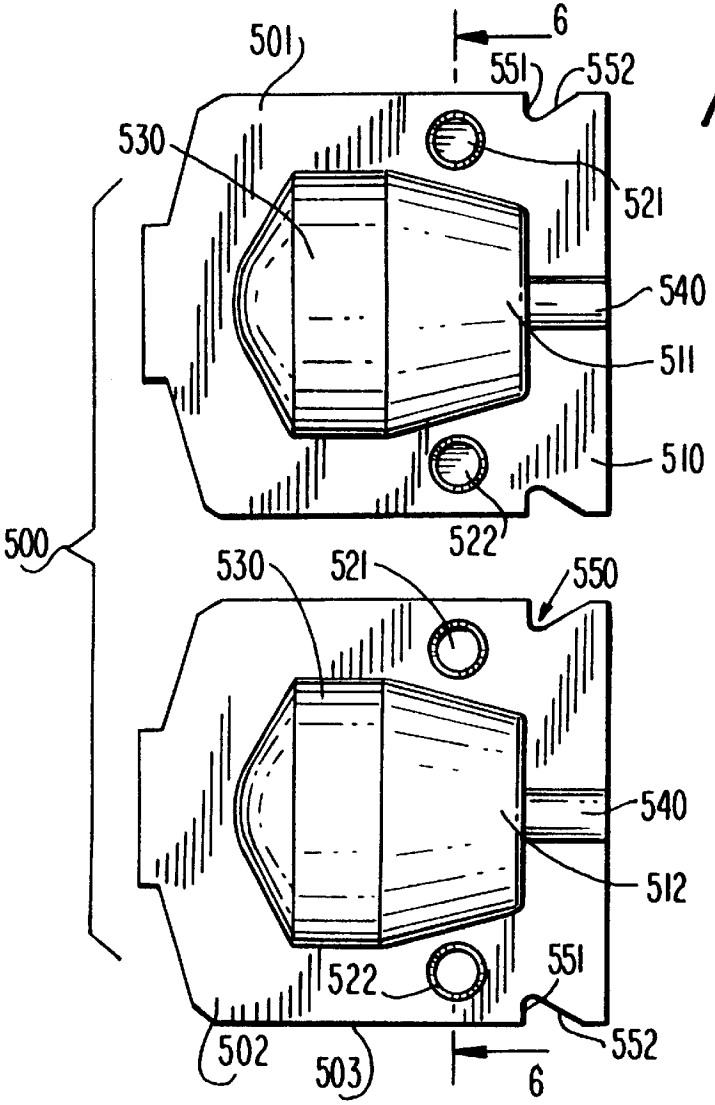

EARRING PIERCER ASSEMBLY FOR STUD GUNS

BACKGROUND OF THE INVENTION

The invention relates generally to an adaptor for an earring stud, and more particularly, to a device and method for using a conventional earring stud gun with earrings of a variety of shapes and sizes.

It has become common to pierce ears and install an earring stud in a single operation in jewelry shops, card stores, malls and the like. This procedure has become common due to the availability of "stud guns" for holding an earring stud and clasp of a post-type earring and using the pointed shaft of the stud to pierce the ear and install the stud in a single movement. Examples of stud guns and their methods of use are disclosed in U.S. Pat. Nos. 4,030,507, 4,921,494, 4,931,060, 5,007,918 and 5,263,960, the contents of which are incorporated by reference.

A simplified version of a conventional stud gun is shown generally as stud gun 100 in FIG. 1. Stud gun 100 is designed for inserting a conventional earring stud 200, shown generally in FIG. 2, into an earlobe for piercing the ear. Stud gun 100 includes a plunger shaft 110 having a plunger 120 at an end thereof. Plunger 120 includes a cavity 130 defined by a generally cylindrical inner surface having a substantially circular cross-section and substantially parallel walls for receiving stud 200.

Earring stud 200 is a post-type earring having an ornamental portion 210 and a shaft 220. Shaft 220 is designed with a pointed tip 230 for piercing an earlobe and is configured to be received in a clasp 240. Studs are generally formed with a generally cylindrical shape, with a substantially circular cross-section and walls parallel to shaft 220. Ornamental portion 210 is sized to fit snugly in cavity 130 of plunger 120 so that when stud 200 is used to pierce an ear, shaft 220 does not pivot significantly with respect to plunger 120. Clasp 240 is mounted in a clasp holder 140 of gun 100 and in use, plunger 120 is urged towards clasp holder 140, so that tip 230 pierces the ear and enters a hole 245 in clasp 240, so that clasp 240 secures stud 200 to an ear.

Referring to FIG. 3, stud gun 100 will not work properly with a more decorative earring 400, which has a spherical ornamental portion 211 as opposed to the uniform stud shape. As shown in FIG. 3, if the earring has a non-cylindrical ornamental portion, it can pivot in cavity 130, as indicated by double arrows A. Similarly, earrings which are smaller than cavity 130 will move during the piercing process. As evident from the foregoing, it is not practical to use a conventional stud gun with earrings having a wide variety of ornamental shapes and sizes, because many desirable shapes will not provide a snug fit within plunger 120. It is this snug fit in cavity 130 of a conventional stud gun which prevents pivoting during insertion.

To overcome the problem of different sized studs conventional stud guns use interchangeable size converting adaptors 300 of varying sizes to accommodate various sized studs as shown in FIG. 4 for permitting the use of stud earrings of different sizes, such as stud 200' with an ornamental portion 210' of large diameter. However, the problems encountered when seeking to use a wide variety of earring shapes has not been overcome in a fully satisfactory manner. Furthermore, it is undesirable to require a user to maintain a large selection of adaptors for various sizes.

One way of piercing an ear with an earring having a non-cylindrical shape has been to sell earrings packaged in capsules, suitable for use with custom designed guns, such as is set forth in U.S. Pat. No. 4,030,507. Another approach has been to sell an earring already installed in a disposable, single use multi-piece molded plastic device for holding the post and clasp and inserting the post through an earlobe into the clasp.

In such a single use plastic device, the ornamental portion of the post is enclosed in an earring housing having a cavity sized to generally conform to the ornamental portion. The cavity also includes a narrow channel so that the post can extend out of the housing. The housing has a generally rectangular box-like shape and is received in a rectangularly shaped recess of the device. None of the portions of the device or housing are constructed or arranged to be used with a conventional stud gun. Because the earring is provided within the body of the gun, it cannot be viewed prior to installation. Rather, the plastic product is built completely around the housing and is designed to be disposed of after each use.

Accordingly, it is desirable to provide a product and method for using a conventional stud gun to install earrings having ornamental portions with a wide variety of shapes and configurations.

SUMMARY OF THE INVENTION

Generally speaking, in accordance with the invention, a product and method are provided for using a conventional stud gun to pierce an ear and install an earring that can have an ornamental portion with a wide variety of shapes and configurations. To effect this method, an earring retainer is provided with a housing having an interior cavity sized to conform generally to the outer dimensions of the ornamental portion of a post-type earring and a tubular shaped portion sized to conform generally to a portion of the shaft of the earring, and an outer shape to conform to the interior of a conventional stud gun plunger so that when the earring stud is enclosed within the earring retainer housing, the retainer will fit snugly in the plunger of a conventional stud gun and the earring will not pivot or shift significantly with respect to the plunger during use. The earring retainer preferably has an outer shape with mating surfaces for mating with the interior of the stud gun plunger or plunger adaptor and parallel to the direction of an earring shaft extending outside the housing. In a preferred embodiment the retainer is formed of symmetrical halves. After use, the halves of the retainer can be designed to fall away and leave the earring in place.

The earring retainer can also have a physical feature, such as a notch or ridge, so that it can be releasably mounted on a handling device and placed in the plunger of the stud gun without the need for a user to touch any portion of the earring retainer or earring prior to use. Such a handling device can include two U-shaped notches for releasably mounting the retainer and can also include recesses or other physical features for releasably securing the clasp portion of the earring.

Accordingly, it is an object of the invention to provide a product and method to allow use of a conventional stud gun with earrings having ornamental portions of various sizes and configurations.

Another object of the invention is to provide an improved product and method for inserting an earring into a conventional stud gun without the need to touch the earring.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 1 is a perspective view of a conventional stud gun showing a conventional post-type earring and earring clasp installed thereon;

FIG. 2 is a perspective view of a conventional post-type earring used with the stud gun of FIG. 1 positioned on an ear after piercing;

FIG. 3 is a side cross-sectional view of an earring with a spherical ornamental head pivoting in the plunger of a conventional stud gun of the prior art;

FIG. 4 is a side cross-sectional view of an adaptor for the plunger of a stud gun as used in the prior art;

FIG. 5 is an exploded top plan view of the halves of an earring retainer constructed in accordance an embodiment of the invention;

FIG. 6 is a cross-sectional view taken along line 6—6 of FIG. 5;

DETAILED DESCRIPTION OF THE PREFERRED EMBODIMENTS

Figure 7:
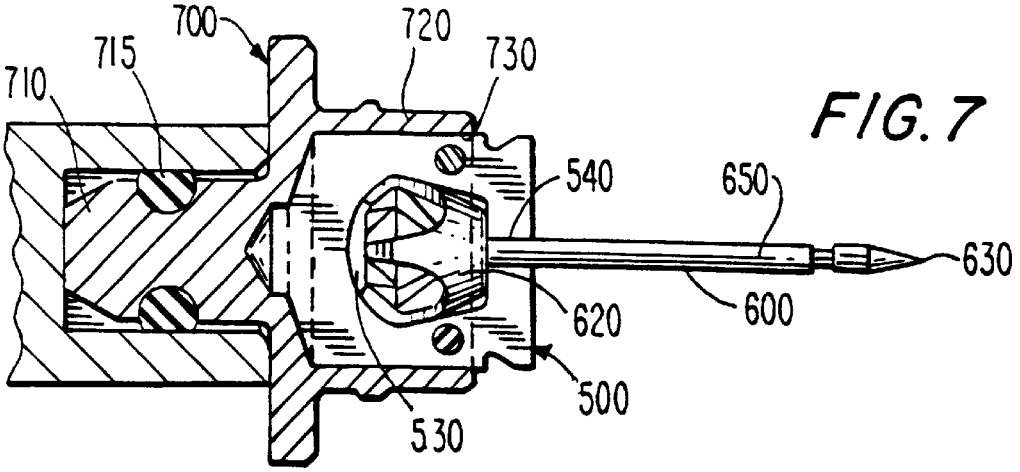
FIG. 7 is a cross-sectional breakaway view of an earring retainer in use with a plunger adaptor, in accordance with an embodiment of the invention.

Referring generally to FIGS. 5–7, an earring retainer in accordance with a preferred embodiment of the invention, shown generally as 500, is formed of a housing having a first half 501 and a second half 502. Each half of retainer 500 is formed with an interior two-stage cavity, identified as cavities 511 and 512 in halves 501 and 502, respectively. Retainer halves 501 and 502 are also each provided with a pin 521 extending from respective half 501 and 502 and a recess 522 within respective half 501 and 502. Each cavity 511, 512 is formed as a two stage cavity having a first stage ornamental cavity portion 530 and a second stage shaft receiving cavity portion 540. The shape of portion 530 is selected to form a cavity as described below to receive ornamental shapes. The shape used in this embodiment is by way of example only.

The housing of retainer 500 has an overall outer cylindrical shape and an outer diameter of about 0.255 inches. However, the diameter can be larger or smaller. Retainer 500 may include at least outer wall 503 which mimics the shape of a conventional stud to prevent movement of retainer 500 once inserted into the stud gun. A cylinder is used by way of example but outer wall 503 may be configured in any acceptable shape to mate with the interior of a conventional stud gun plunger. Similarly, the outer dimensions of retainer 500 may vary as needed. Alternative embodiments are advantageously less than about 0.4 inches. If sized to fit in a conventional stud gun plunger, without a size adapter, it should have an outside diameter of about 0.16 inches.

When retainer halves 501 and 502 are joined together, pins 522 are received by respective recesses 521 and also halves 511, 512 with each other. When retainer halves 501 and 502 are combined to form retainer 500, central recesses 511 and 512 combine to form first stage ornamental cavity 530 and tubular shaped second stage shaft cavity 540. Ornamental cavity 530 is sized and dimensioned to conform generally to the ornamental portion of a post-type earring 600 (FIG. 8) having an ornamental head 620 that does not fit properly in the plunger of a conventional stud gun. Thus, if ornamental head portion 620 of earring 600 is cube shaped, shaped like an actual diamond in a multi-prong setting, cone shaped, sphere shaped and so forth, or even cylindrically shaped, cavity 530 of retainer 500 can be sized and dimensioned to receive an earring of such shape.

Referring to FIG. 7, second stage shaft cavity 540 is sized to snugly receive a shaft 650 of earring 600. Shaft cavity 540 must be sufficiently long to help substantially prevent earring 600 from pivoting with respect to retainer 500, so that it will be inserted straight through the ear into a clasp. If shaft cavity 540 is too long, it will interfere with the ability of an earring shaft tip 630 to protrude sufficiently through the ear to engage a clasp. Shaft cavity 540 should have a diameter that is large enough that it does not prevent the halves from closing and no so great that it allows excessive movement of shaft 650.

A stud gun adaptor can allow a stud gun to be used with a variety of different sized studs. Stud gun adaptor 700 (FIG. 7) includes a male portion 710 having a generally cylindrical shape with a diameter for snugly fitting in receptacle 130 of plunger 120. Male portion 710 may include a friction member 715, such as a rubber or plastic O-ring to help prevent plunger size converter 700 from slipping out of receptacle 130 during use. Plunger adaptor 700 also includes a female portion 720 having a receptacle 730 dimensioned to securely receive a stud. The inner diameter of receptacle 730 is sized to provide a snug fit with a stud. In the event the outer diameter of retainer 500 is larger than the inner diameter of cavity 130 of plunger 120, stud gun plunger adaptor 700 can be employed to increase the available outer diameters which can be used for earring retainers that can be used with a conventional stud gun.

Retainer 500 should be formed with sufficient length to permit a secure fit within recess 130 or stud gun adaptor 700. However, the length should not be too great, so as to be unwieldy.

An earring retainer in accordance with the invention can be provided with a physical feature to permit installation in the plunger (or plunger adapter) of a stud gun, without the need to touch the adaptor. As shown in FIG. 5, retainer 500 may be provided with a groove 550 defined by a pair of opposed surfaces 551 and 552 forming a dove tail 510.

Figure 8:
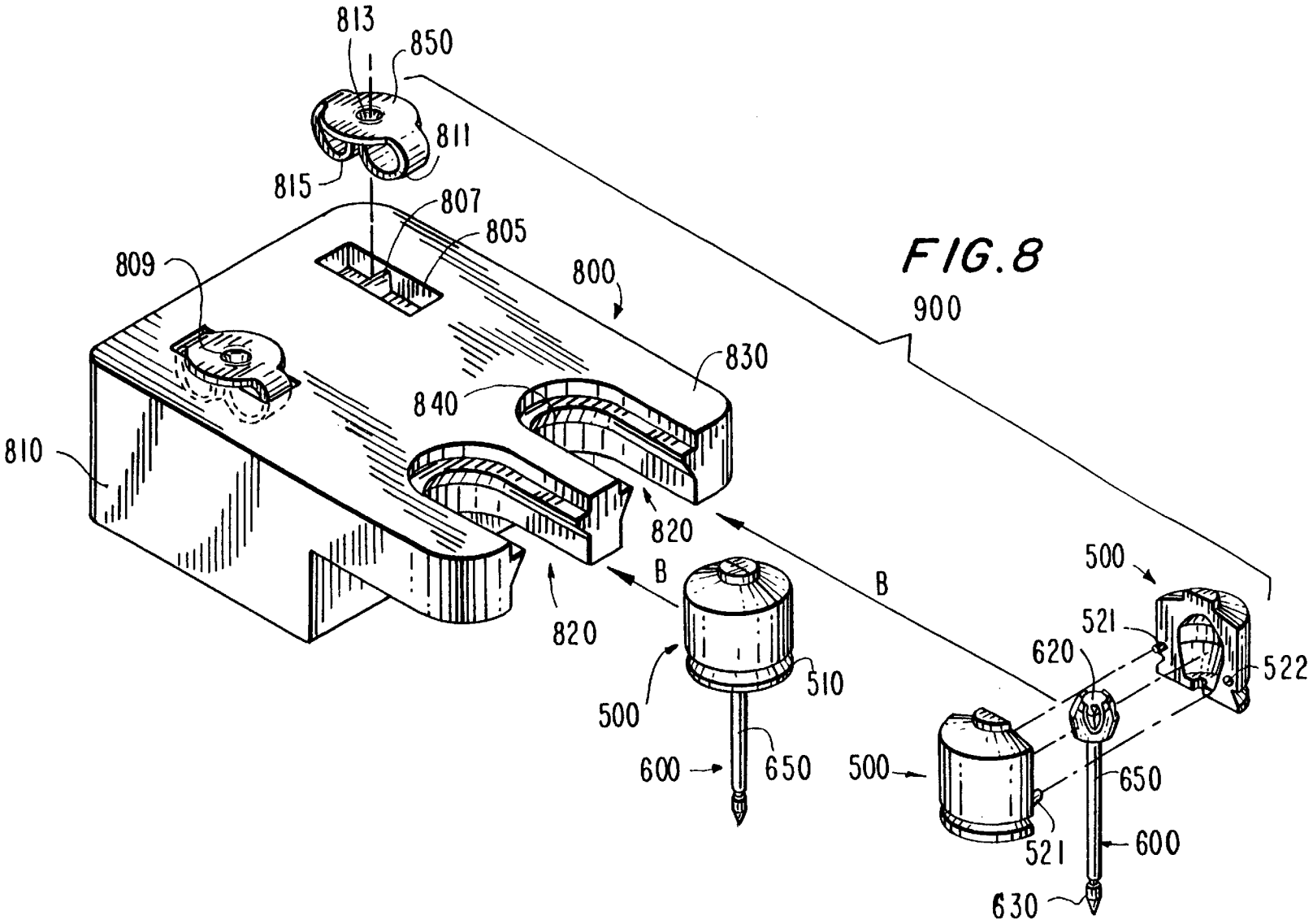
FIG. 8 is an exploded perspective view of an earring piercer assembly for a pair of earrings mounted in accordance with an embodiment of the invention.
Figure 9:
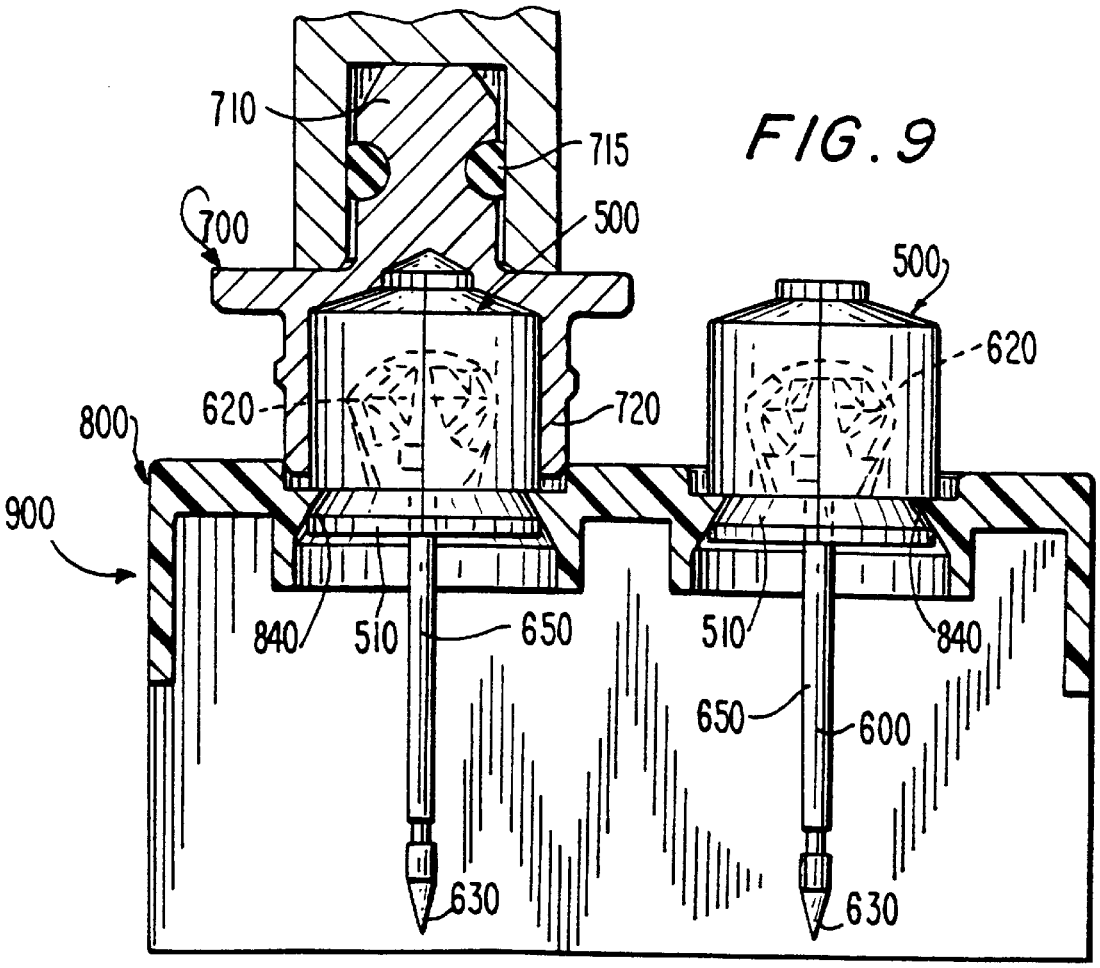
FIG. 9 is a partial cross-sectional view showing a plunger of a conventional stud gun used to remove an earring enclosed is an earring retainer from the stud block in accordance with an embodiment of the invention.

Reference is now also made to FIGS. 7–9 wherein a carrier for carrying the retainer of an earring piercer assembly is shown. A carrying block 800 for transporting ear piercing earrings includes a body 810 having a pair of U-shaped grooves 820 formed in a cantilever shelf 830 of body 810. Each recess 820 includes a ridge 840 extending along the length of groove 820.

Surfaces 551 and 552 of retainer 500 receive ridge 840 as retainer 500 is slid in the direction of arrows B into groove 820. Groove 820 is dimensioned so that ridge 840 prevents separation of halves 511, 512 when held by carrying block 800. Carrying block 800 can now be used to transport earring 600 from the retainer assembly site to the piercing site.

Ear piercing earrings such as 600 are utilized for piercing ears with a clutch 850 (FIG. 8). Therefore, to facilitate the piercing process and transport of ear piercing earring clutch pairs, in a preferred embodiment, clutches 850 may also be transported on carrying block 800. Body 810 is formed with a blind channel 805. Blind channel 805 includes a rib 807 disposed therein. Conventional clutches 850 are formed as a single piece of resilient material having a C-shaped configuration forming two symmetrical loops 811 having ends 813. An opening 809 is provided in the material for receiving the piercing pin 630 of earring 600 and is co-axial with the space between ends 813.

Rib 807 disposed within blind channel 805 has a width slightly greater than the space between ends 813 to form a tension fit therewith. Clutch 850 can be slid onto the stud gun directly from carrying block 800. As a result, if dimensioned properly, body 810 can be used to transfer clutch 850 to a stud gun, without the need to touch clutch 850.

During use, an ear piercing earring assembly 900, which includes retainer 500, earring 600 and carrying block 800 is assembled. An ornamental earring 600 is selected and halves 511, 512 are positioned about the ornamental head 620 of earring 600. Pin 521 of each respective half 511, 512 of retainer 500 is inserted into the corresponding recess 522 of the other half to dispose ornamental head 620 within cavity 530 of retainer 500 and shaft 650 within cavity portion 540 of retainer 500. Retainer 500 is then slid in the direction of arrow B along a ridge 840 of a groove 820 maintaining halves 511, 512 retainer 500 about earring piercing earring 600. At the same time, clutches 850 are placed within respective blind channels 805. Assembly 900 is then sterilized and packaged for shipping, preferably in a sterile container with a transparent viewing portion.

At the piercing site, earring piercer assembly 900 is removed from the package. Retainer 500 is positioned within either adaptor 700 (as shown in FIGS. 7,9) or the plunger of the stud gun itself. Retainer 500 with earring 600 is then slid from groove 820. Because retainer 500 is sized and shaped to provide a snug fit with the interior of adaptor 700, adaptor 700 maintains the halves of retainer 500 about ornamental head 620 of ear piercing earring 600 and also prevents pivoting of retainer 500 during the piercing process. Clutch 850 is then placed in the anvil of the stud gun and the ear is pierced in the conventional manner. Upon completion of the piercing process, the stud gun plunger is moved away from the ear so that retainer 500 is disconnected from the stud gun. With nothing acting to maintain the halves in contact with each other, they may be easily separated to expose the ornamental head of the ear piercing earring or they may simply fall away of their own weight if the pins in the recesses are dimensioned so as not to form an interference fit.

To pierce an ear and install a post-type earring, which does not necessarily fit properly in the plunger of a conventional stud gun, in a single step, in a sanitary and convenient manner, first, an earring having a shaft portion and an ornamental portion is provided. Next, an earring retainer is provided. The retainer should have outer dimensions for fitting snugly in the plunger of a conventional stud gun or a plunger adaptor that changes the diameter of the recess in the plunger of a conventional stud gun, so that the adaptor does not shift, pivot or otherwise move significantly during use. Preferred earring retainers are formed with an internal cavity dimensioned to releasable secure the earring with respect to the earring retainer during use, by substantially conforming to the dimensions of the ornamental portion of the earring and to permit the shaft to extend therethrough. The earring retainer is preferably formed with two halves, but can be formed otherwise. Regardless of the actual shape, the earring retainer should not shift or pivot with respect to the stud gun during use. The retainer is releasably secured over the ornamental portion and preferably a short length of the shaft of the earring.

The earring retainer can have a physical feature, such as a groove, so that it can be mounted onto a support for handling and viewing purposes. A suitable support can have two U-shaped recess for receiving the retainer by a friction fit. In a preferred embodiment, enough of the earring retainer extends beyond the top surface of the support, after mounting, so that a plunger of a conventional stud gun, or a stud gun having an adaptor used to increase the diameter of the recess of the plunger, can be slid over the earring retainer and then be used to slide the earring retainer and earring out of the grooves, without the need of a user to touch the earring retainer or earring. The support can also include recesses or other physical features for releasably securing clasps for the earrings, such that the clasps can be slid from the support onto a clasp holder of a conventional stud gun, without the need for a user to touch the clasps.

Thus a support, such as a carrying block having a pair of earrings enclosed in earring retainers and a pair of clasps for said earrings can be sold as a unit. The unit can be sealed within a container, such as one having a transparent plastic cover. The earring retainer can also be made of transparent plastic to permit handling and viewing of the earring, without the need to touch the earring, the retainer or any part that would come into contact with an ear during insertion. The support with the earrings and clasps can be removed from the package and one need only handle the support to install both the earring and clasp in the stud gun and then insert the earring through the earlobe into a clasp in a highly sanitary manner.

It will thus be seen that the objects set forth above, among those made apparent from the preceding description, are efficiently attained and, since certain changes may be made in carrying out the above method and in the constructions set forth above without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An earring retainer for adapting an earring having an ornamental portion and shaft portion for use in a stud gun having a plunger, comprising:

a housing formed of two releasably securable portions, said housing having an inner surface defining an interior two-stage cavity, the first stage of the cavity sized to conform generally to the outer dimensions of the ornamental portion of an earring and a second stage dimensioned to conform generally to the shaft portion of an earring, the second stage sized so that a portion of the shaft of an earring extends outside the housing, the housing having an outer wall sized and shaped to fit in the plunger of a stud gun and to prevent relative movement thereto when said housing is disposed within the plunger of a stud gun and the releasably securable portions of the housing constructed and assembled to separate from the earring after the stud gun is used to pierce an ear with the earring.

2. The earring retainer of claim 1, wherein the outer surface of the housing includes a ridge to facilitate mounting the housing on a carrying block.

3. The earring retainer of claim 1, wherein a groove is formed on the outer surface of the housing to facilitate mounting the housing on a carrying block.

4. The earring retainer of claim 1, including an earring having a non-cylindrical ornamental portion within the cavity, wherein the surface defining the first stage of the cavity conforms substantially to the dimensions of the ornamental portion of the earring.

5. The earring retainer of claim 1, wherein the housing is formed of clear plastic.

6. The earring retainer of claim 1, wherein the housing is formed of two halves, each half including a pin and a recess, each respective half receiving the pin of the other half.

7. The earring retainer of claim 1, wherein the earring adaptor has a generally cylindrical surface in the longitudinal direction.

8. An earring assembly, comprising:

a carrying block and a releasably securable earring retainer releasably mounted on the carrying block, said retainer having an inner surface defining an interior cavity sized to conform generally to the outer dimensions of an ornamental portion of an earring, the retainer having an outer surface to substantially prevent movement of an earring within the cavity when said retainer is disposed within the plunger of a stud gun.

9. The assembly of claim 8, including an earring having an ornamental portion disposed within the interior cavity.

10. The assembly of claim 9, wherein the retainer has a ridge, and the carrying block engages the ridge for maintaining said retainer on said carrying block.

11. The assembly of claim 10, wherein the retainer includes a groove adjacent the ridge.

12. The assembly of claim 9, wherein the outer surface of the retainer includes a groove, the carrying block includes a substantially U-shaped recess having a ridge and the retainer is mounted by a friction fit of the ridge to the groove.

13. The assembly of claim 12, wherein the retainer is formed of clear plastic.

14. The assembly of claim 13, wherein the earring, retainer and support are enclosed in a container having a transparent portion for viewing the earrings through the retainer.

15. The assembly of claim 12, wherein the retainer is formed in two or more pieces held together by the carrying block.

16. A method for piercing an ear and installing an earring with a stud gun having a plunger with a substantially cylindrically shaped recess for receiving a stud comprising:

providing an earring having an ornamental portion and a shaft portion and an earring retainer having an interior surface defining an interior cavity dimensioned to releasably secure the ornamental portion of the earring and substantially limit the ability of the shaft to pivot with respect to the earring retainer, the earring retainer having an outer surface shaped to be received by the recess of the plunger of the stud gun and prevent pivoting relative thereto; releasably securing the retainer over the ornamental portion of the earring; placing the retainer within the recess of the stud gun plunger; using the stud gun to push the shaft of the earring through the ear; and then releasing the earring from the retainer.

17. The method of claim 16, wherein the retainer containing the earring is provided mounted on a support and the retainer is positioned within the recess of the stud gun by sliding the recess over the retainer while the retainer is still on the support.

18. A retainer for an earring, comprising a housing, said housing defining an interior cavity sized and dimensioned to receive an ornamental portion of an earring having an ornamental portion coupled to a shaft, and limit movement of the earring shaft with respect to the retainer, the housing having an outer surface dimensioned and sized to be received by the plunger or adapter for a plunger of a stud gun and substantially prevent pivoting of the shaft with respect to the plunger of a stud gun.

19. An ear piercing assembly, comprising:

a carrying block releasably supporting at least one earring, the carrying block including at least one blind channel with a rib thereon, at least one earring clutch having a pair of resilient ends mounted in the channel by tension fit with the rib.

20. The assembly of claim 19, wherein the resilient ends are spaced apart and the rib is slightly wider than the space between the ends.

21. The assembly of claim 20, wherein the clutch and carrying block are constructed and arranged so that the clutch can be slid onto a stud gun from the carrying block without the need to touch the clutch.

22. The assembly of claim 21, wherein the clutch is raised up from the surface of the carrying block.

23. The assembly of claim 22, wherein the carrying block, earring and clutch are sterilized and packaged in a transparent container.

24. An earring retainer for adapting an earring having an ornamental portion and a shaft portion for use in a stud gun, comprising:

a releasably securable housing, said housing having an inner surface defining an interior two-stage cavity, the first stage of the cavity sized to conform generally to the outer dimensions of the ornamental portion of an earring and a second stage dimensioned to conform generally to the shaft portion of an earring, with a portion of the shaft extending beyond the housing, wherein the housing is formed of two halves, each half including a pin and a recess, each respective half receiving the pin of the other half, and the housing having an outer wall to prevent movement when said housing is disposed within the plunger of a stud gun.

25. The earring retainer of claim 24, wherein the outer surface of the adapter includes a ridge to facilitate mounting the housing on a carrying block.

26. The earring retainer of claim 24, wherein the earring adapter has a generally cylindrical surface in the longitudinal direction.

27. An earring assembly, comprising:

a carrying block and a releasably securable earring retainer releasably mounted on the carrying block, said retainer having an inner surface defining an interior cavity sized to conform generally to the outer dimensions of an ornamental portion of an earring, and an earring having an ornamental portion disposed within the interior cavity of the retainer, the retainer including an outer surface configured to substantially prevent movement of the earring within the cavity when said retainer is disposed within a plunger of a stud gun, and wherein the outer surface of the retainer includes a groove, the carrying block includes a substantially U-shaped recess having a ridge and the retainer is mounted by a friction fit of the ridge to the groove.

28. The assembly of claim 27, wherein the retainer is formed of clear plastic.

29. The assembly of claim 27, wherein the earring, retainer and support are enclosed in a container having a transparent portion for viewing the earring through the retainer.

30. The assembly of claim 27, wherein the retainer is formed in two or more pieces held together by the carrying block.

31. The assembly of claim 27, wherein the retainer has a ridge, and the carrying block engages the ridge for maintaining said retainer on said carrying block.

* * * * *